US009234520B2

(12) United States Patent
Morando

(10) Patent No.: US 9,234,520 B2
(45) **Date of Patent: *Jan. 12, 2016**

(54) RISERLESS TRANSFER PUMP AND MIXER/PRE-MELTER FOR MOLTEN METAL APPLICATIONS

(75) Inventor: Jorge A. Morando, Solon, OH (US)

(73) Assignee: Pyrotek, Inc., Solon, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/442,697

(22) Filed: Apr. 9, 2012

(65) Prior Publication Data

US 2013/0170946 A1 Jul. 4, 2013

(51) Int. Cl.
*F04D 7/06* (2006.01)
*F04D 1/14* (2006.01)
*F04D 29/44* (2006.01)

(52) U.S. Cl.
CPC *F04D 7/065* (2013.01); *F04D 1/14* (2013.01); *F04D 29/445* (2013.01)

(58) Field of Classification Search
CPC ..... F04D 1/14; F04D 7/065; F04D 29/445
USPC ..... 415/89, 206, 203, 212.1, 219.1, 222, 415/226, 184, 208.1; 416/231 A; 266/235; 417/423.1, 423.14, 424.1
See application file for complete search history.

(56) References Cited

U.S. PATENT DOCUMENTS 8,246,295 B2 * 8/2012 Morando ..... 415/89
2010/0104415 A1 * 4/2010 Morando ..... 415/1

* cited by examiner

*Primary Examiner* — Edward Look
*Assistant Examiner* — Juan G Flores
(74) *Attorney, Agent, or Firm* — Fay Sharpe LLP

(57) ABSTRACT

A pump for processing molten metal having an enlarged tubular body which houses a centrifugal pump at its bottom end. The bottom end has a concave curved shape whose shape is a function of the particular type of vortex to be created for the application at hand. This curved portion of the body receives the ejected molten metal from the impeller and forms an uplifting axial vortex within the tubular section of the body. The pump is designed to cooperate synergistically with said body such that the uplifting axial vortex to climb up the inner wall of the body up to and out of an outlet formed in the upper end of the body. A radial vane impeller is formed in the back plate of the impeller. When the impeller is rotated, solid particles introduced into the body are accelerated radially by the back plate impeller into the vortex.

20 Claims, 4 Drawing Sheets

RISERLESS TRANSFER PUMP AND MIXER/PRE-MELTER FOR MOLTEN METAL APPLICATIONS

FIELD OF THE INVENTION

The present invention relates to lifting molten metals and, more particularly, to a pump creating a vortex within a lift tube to elevate and mix molten metal.

BACKGROUND OF THE INVENTION

A typical molten metal facility includes a furnace with a pump for moving molten metal. During the processing of molten metals, such as aluminum and zinc, the molten metal is normally continuously circulated through the furnace by a centrifugal circulation pump to equalize the temperature of the molten bath. These pumps contain a rotating impeller that draws in and accelerates the molten metal creating a laminar-type flow within the furnace.

To transfer the molten metal out of the furnace, typically for casting the metal, a separate centrifugal transfer pump is used to elevate the metal up through a discharge conduit that runs up and out of the furnace. As shown in FIG. 1, a typical prior art transfer pump includes a base 5, two to three support posts 6 (only one shown), a shaft-mounted impeller 7 located within a pumping chamber or volute 5*a* in the base 5, a motor 8 and motor mount 9 which turn the impeller, bearings 10 that support the rotating impeller (and shaft), and a riser tube or conduit 11 located at the outlet of the base. The riser 11 is provided to allow the metal to lift upward over the sill edge of the furnace in order to transfer some of the molten metal 12 out of furnace into ladles or molds.

A well-known problem with previous transfer pumps, however, is that the relatively narrow riser tube 11 becomes clogged as small droplets of the molten metal accumulate in the riser each time the pump stops transferring and the metal stops flowing through the riser. Initially, the metal accumulates in the porosity of the riser tube material (typically graphite or ceramic) and then continues to build upon the hardened metal/dross until a clog 13 occurs. As a result of this problem, furnace operators must frequently replace the transfer pump's riser tube as they are too narrow to effectively clean. This replacement typically requires the furnace to be shut down for an extended period to remove the clogged riser tube.

Several treatments have been used to alleviate this riser-clogging in transfer pumps. Including impregnating, coating, and inert gas pressurization of the riser to reduce the build-up within the tube. Another method pump manufacturers employ is to simply increase the diameter of the riser to delay the blockage. These treatments have varying degrees of success, but still only delay the inevitable clogging of the riser.

Another common operation in a molten metal facility is to add scrap metal, typically metal working remnants or chips, to the molten bath within a furnace. The heat of the bath melts the chips. Currently, the added chips are simply allowed to fall into the bath or may be mixed into the molten metal by a circulation pump. The current process(es), however, is not effective to fully immerse the solid chips into the molten bath resulting in a longer melt time.

In view of the current inefficient use of molten metal transfer pumps, there is a need for a molten metal pump that overcomes all of the above-indicated drawbacks of prior transfer pumps.

SUMMARY OF THE INVENTION

The present invention provides a molten metal pump including an elongated body having an elongated straight tube that terminates in a curved bottom end whose curvature depends on a) the particular application; b) the total tangential velocity of the fluid exiting the impeller; and c) the particular specific speed of the pumping section, i.e., $$Ns = \frac{\sqrt{Q} \times RPM}{Ho^{\frac{3}{4}}}$$

where Q is the flow in gallons per minute; Ho is the outlet head at rated flow; and RPM is the angular velocity of the impeller.

A centrifugal impeller is seated in an inlet opening formed in the center of the bottom end. The curved shape of the body's bottom end provides a smooth upward transition for metal ejected from the impeller to the inner walls of the straight tube. The rotation of the impeller centered in the curved body's end results in the ejected flow of molten metal to create a vertical uplifting vortex which climbs the inner walls of the body to a outlet opening in an upper portion wall.

It is an advantage of the present invention to provide a pump which creates a forced vertical uplifting vortex of molten metal within a vertical tube body of the pump to lift the whirling molten metal for transferring, mixing, and/or pre-melting applications.

It is another advantage of the present invention that the particular curved shaped lifting cavity accommodates a large combination of flows and lifts as it has a relatively large internal diameter allowing the inner walls to be readily accessed for cleaning and removal of accumulated metal and dross.

It is still another advantage of the present invention over prior art transfer-type pumps is that the present invention eliminates the support posts, riser tube, and one impeller bearing thereby reducing the complexity of the pump system and reducing the number of components subject to deterioration due to the molten metal environment and which must eventually be replaced.

It is yet another advantage of the present invention to provide an impeller having a bottom plate with a plurality of radial vanes facing into the pump's tubular body.

It is still yet another advantage of the present invention that the radial vanes of the bottom plate causes, when metal scrap chips are inserted into the pump's tubular cavity, the metal chips to be directed radially outwardly into the pump-generated uplifting vortex of molten metal. The rotational velocity of the impeller causes the chips to penetrate the surface of the vortex to fully immerse the chips within the molten metal at a force proportional to the square of the radial velocity, which indicates the wide range of melting capacity, i.e., the change in melting capacity, $\Delta\tau = fn(\Delta T, Q, V^2)$, where $\Delta\tau$ is the time to melt; Q is the metal flow per pound of particles; V is the radial velocity; and $\Delta T$ is the difference in temperature (particles versus metal flow).

These and other objects, features and advantages of the present invention will become apparent from the following description when viewed in accordance with the accompanying drawings.

BRIEF DESCRIPTION OF THE DRAWINGS

The description refers to the accompanying drawings in which like reference characters refer to like parts throughout the several views, and in which.

DETAILED DESCRIPTION OF THE INVENTION

Figure 1:
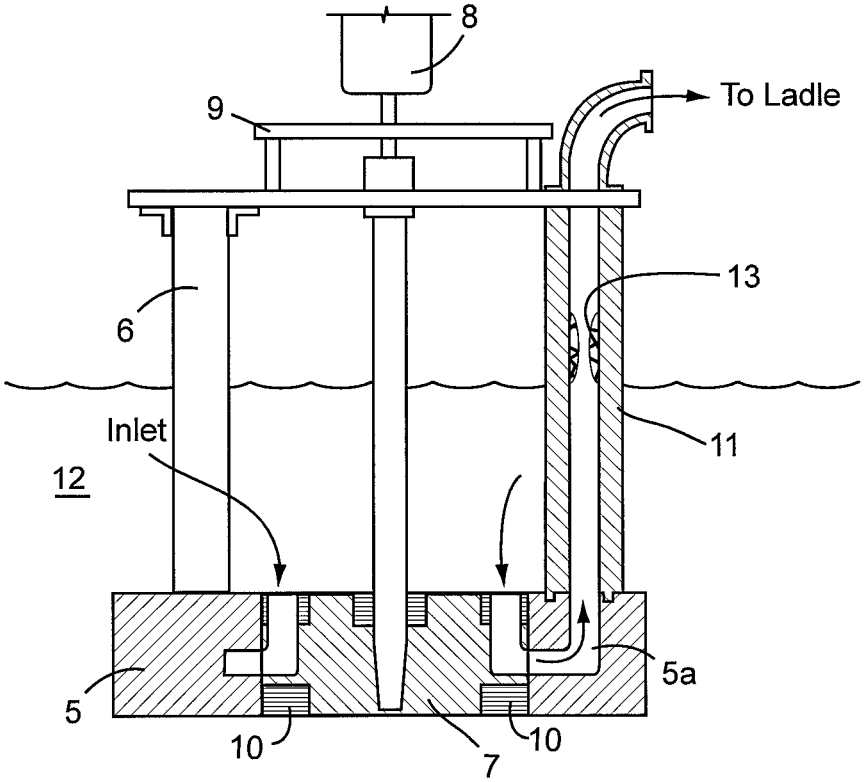
FIG. 1 (Prior Art)
FIG. 1 is a side sectional view of a prior art transfer pump having a riser tube.
Figure 2:
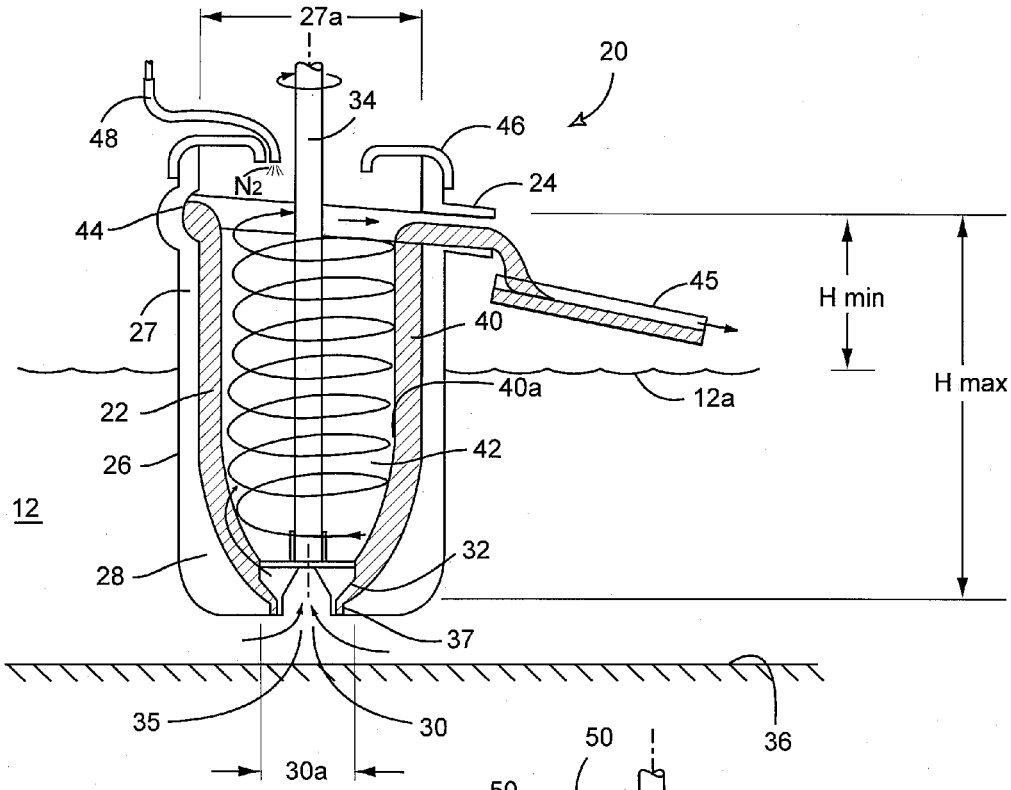
FIG. 2 is a side sectional view of the present invention used in a transfer pump application.

Referring now to FIG. 2, the present invention is molten metal pump 20 which creates a forced vortex of accelerated molten metal within a vertical tube 22 in the pump to lift or raise the molten metal to an outlet 24 in the upper end of the pump.

Pump 20 includes an elongated tubular pump body 26 having a substantially straight cylindrical inner tube wall 27 and a curved bottom end 28. As will be discussed in greater detail below, the curvature of bottom end 28 is dependent on the particular application of the pump 20: transfer, mixing, or pre-melting. An inlet opening 30 is formed in the center of the concave end 28. A centrifugal impeller 32 is mounted within opening 30 and is rotated by an elongated output shaft 34 which runs concentrically down through the center of tube body 26. Shaft 34 is driven by a conventional motor (not shown). Inlet opening 30 and the impeller's inlets are suspended above the furnace floor 36 to ensure an adequate amount of molten metal is pulled into pump 20.

Impeller 32 rotates on bearings 37 disposed between the impeller and body 26 to draw in molten metal from bath/matrix 12, which is accelerated in both the radial and tangential direction and expels the accelerated molten metal out of the impeller and into bottom end 28 of the pump body. Impeller 32 is preferably a high velocity and/or high efficiency configuration to generate the molten metal lifting vortex within pump 20. Two examples of such an impeller configuration include the type disclosed in my issued U.S. Pat. No. 7,326,028 entitled HIGH FLOW/DUAL INDUCER/HIGH EFFICIENCY IMPELLER FOR LIQUID APPLICATIONS INCLUDING MOLTEN METAL ("dual inducer impeller") and my pending U.S. patent application Ser. No. 12/239,228 entitled HIGH FLOW/HIGH EFFICIENCY CENTRIFUGAL PUMP HAVING A TURBINE IMPELLER FOR LIQUID APPLICATIONS INCLUDING MOLTEN METAL ("turbine impeller") which are both incorporated herein by reference.

The pump body 26 is preferably formed from a material suitable for molten metal applications, such as a boron nitride impregnated alumina refractory material or equivalent. It should be appreciated that since most transfer-type molten metal pumps typically only need to lift the metal three to four feet vertically, the straight tube 27 of the pump body has a similar overall length/height.

Tube 27 terminates in a curved shaped end 28, that, at a low specific speed (Ns <1500) and at low RPM, provides the contour necessary for the impeller to generate the vortex type required by the application at hand.

As shown in FIG. 2, a transferring application is illustrated where the curved shape of end 28 has its focus proximate to its vertex. Further in this transferring application, the forced vortex 40 (i.e., where there is little to no shear in the fluid such that the fluid essentially rotates as a solid body) generated by the rotating impeller takes the shape of what I have termed a "super forced vortex", where the vortex of fluid forms a near constant or uniform depth/thickness and the free surface 40*a* of the fluid has substantially the same shape as the underlying cavity 42 because the acceleration of the fluid increases at a constant rate with the radius at the point in consideration (defined by tube 27 and curved end 28) in pump body 26.

In the preferred embodiment of a transferring pump, body 26 includes an exit volute 44 in the upper end of the body. Exit volute 44 is a channel recessed in body 26 which redirects the whirling vortex 40 of molten metal out through outlet opening 24 and onto a conventional molten metal sluice 45 to move the exiting molten metal away from the furnace.

The maximum lift, "Hmax", (i.e., the maximum vertical distance a given pump 20 will elevate a given molten metal from the inlet of the impeller) will depend on: a) the internal diameter 27*a* of the pump body's tube; b) the impeller's outer diameter 30*a*; and c) the speed (in rpm) at which the impeller 32 is rotated. For optimum transfer lift the impeller's outer diameter 30*a* is preferably within the range of one-third to one-half the internal diameter 27*a* of the pump body tube 27. The minimum lift, "Hmin", is the vertical distance between the molten metal line 12*a* in the furnace and the height to the outlet opening 24, which results in sufficient material exiting the pump 20 to maintain the desired vortex formed by the incoming/accelerating molten material.

$$Ns = \frac{\sqrt{Qo} \times RPM}{(H\max - H\min)^{3/4}},$$

where $$H_{shut\ off} = k\frac{V^2}{g}$$

where k=0.60-0.80 depending on the impeller type and (Hmax−Hmin)<Hs.o.<2(Hmax−Hmin)

Pump 20 further preferably includes an annular lid or splash protector 46 which substantially covers the upper open end of the tube body 26 while leaving a central opening to allow access for the drive shaft 34. In one embodiment, pump 20 includes a gas injection tube or conduit 48, which passes into cavity 42 to introduce a gas into the molten metal, such as injecting nitrogen gas to flux/clean molten aluminum and prevent the formation of aluminum oxide ($Al_2O_3$).

Figure 3:
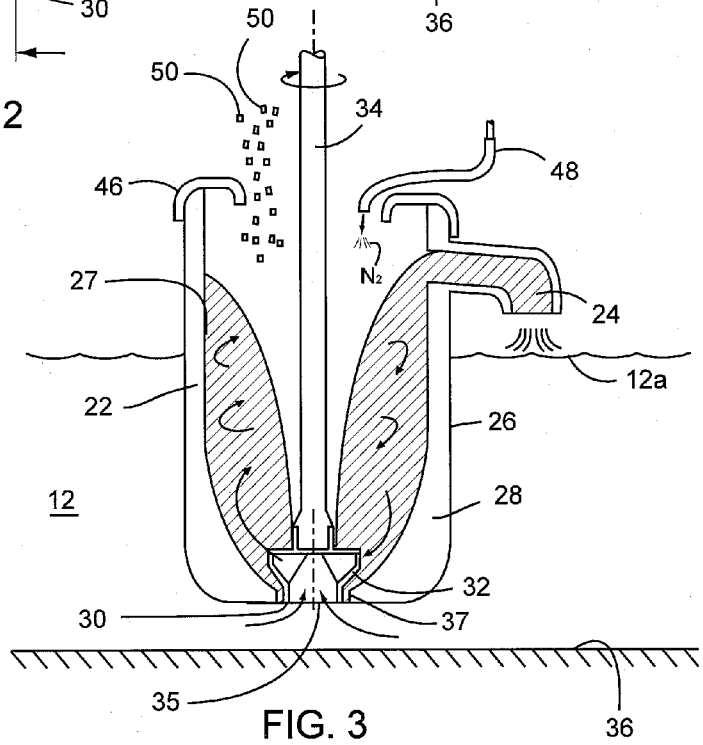
FIG. 3 is a side sectional view of the present invention used in either a mixing or pre-melting application.

Referring now to FIG. 3, if the pump 20 is used as a metal mixer or pre-melter, chips or particles 50 of various materials are introduced into body 26 through the upper end. In one embodiment, the shape of cavity bottom 28 has a wider configuration than the transferring pump above, with the focus being as far as practicable from the curve vertex. In the mixing application, the height of the lifted metal should be maintained at a minimum to ensure proper dispersion of the particles 50 added for mixing with the metal matrix/bath 12. This will depend on: a) the materials being mixed; b) the particles' size; c) the wetability of the particles; d) the mixing speed (RPM); and e) the impeller configuration and tip velocity. In one embodiment of this mixing application, an "ordinary" forced vortex 40 is generated where the free surface 40*a* is parabolic resulting in a varying radial thickness or depth of the molten metal, which narrows as the flow rises up the tube walls 27 (Ns >1500). That is, more molten metal can be found proximate to the lower end 28 in pump body 26 than at the upward end of the vertical tube.

As shown in FIG. 3, while mixing, the flow out of the pump 20 returns the lifted molten metal to the furnace until the mixing is completed, then casting can start. Preferably, the outlet 24 is located proximate to the furnace metal line 12*a* to reduce turbulence and dross formation.

If the riserless pump 20 is utilized as a pre-melting system (i.e., 300<Ns<1500) the conditions are similar to the mixing application described above, except the particles' 50 residence time in the vortex 40 and the vortex's outlet flow should be such as to guarantee the complete melting of the material 50 added to the vortex to assure sufficient heat is available to cause the solid particles to melt without overcooling either the melting or the melted flow.

In the mixing and pre-melting applications, the forced vortex 40 would be optimally generated by means of my dual inducer impeller or turbine impeller. These impellers generate a very balanced flow versus head performance curve assuring high melting flow and moderate to high recirculation (residence time).

For optimum mixing or pre-melting applications the impeller outside diameter 30*a* is preferably within the range of one-fourth to one-third the internal diameter 27*a* of the pump body tube 27 to guarantee larger flows and longer residence times of the particles to be melted within or dispersed throughout the metal matrix/bath 12.

Figure 4:
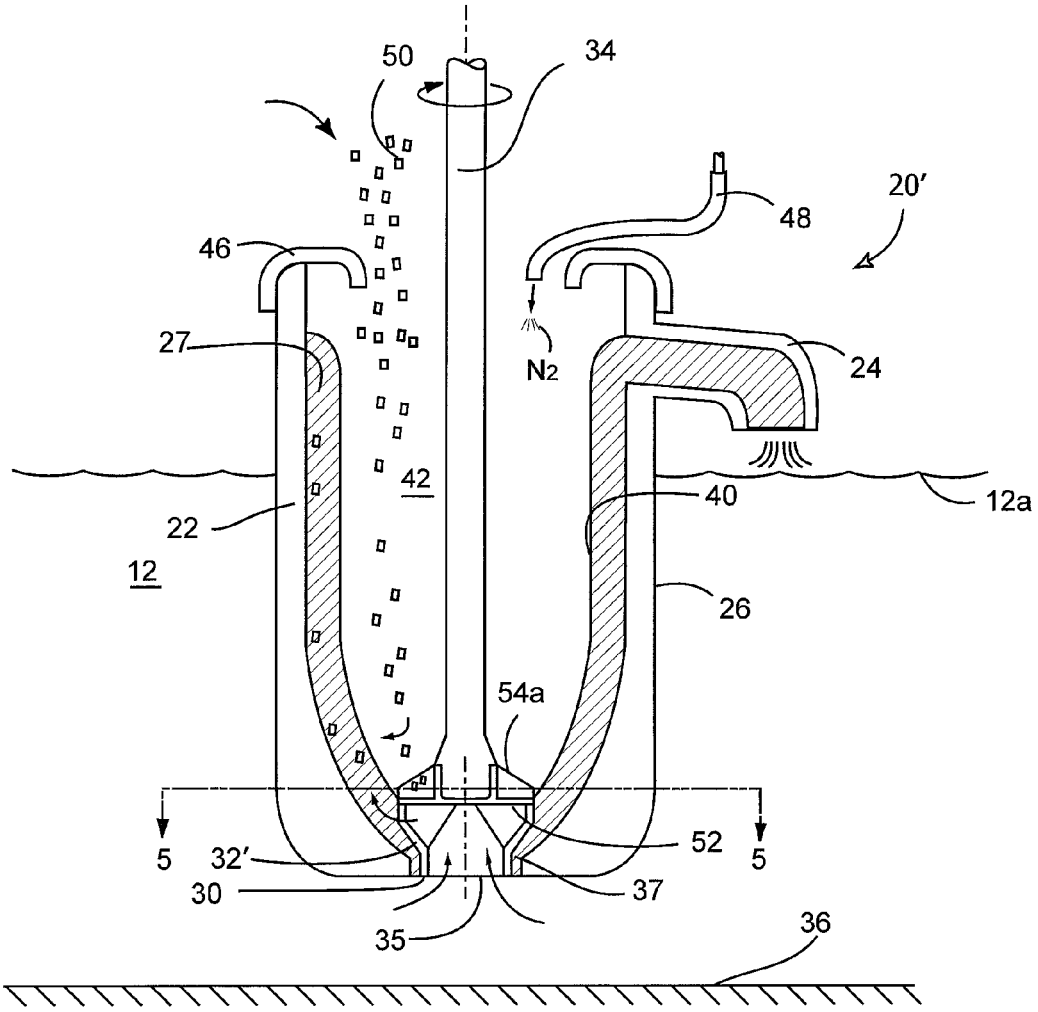
FIG. 4 is a side sectional view of an alternate embodiment of the present invention having an impeller with a plurality of radially extending vanes formed into the impeller's back plate.
Figure 5:
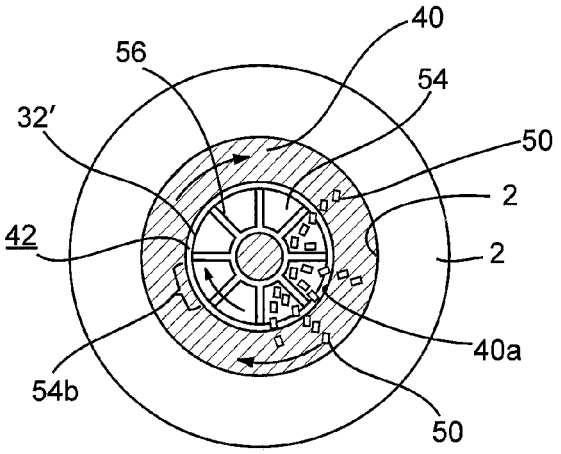
FIG. 5 is a top sectional view through line 5-5 in FIG. 4 showing the radially accelerated metal particles penetrating the impeller induced vortex.

Referring now to FIGS. 4 and 5 an alternate riserless pump 20' having an impeller 32' which is substantially the same as impeller 32 described above, except that impeller 32' has a much thicker back plate portion 52 (i.e., the face of the impeller opposite to the surface bearing the molten metal inlets 35) than impeller 32. Within the thickened back plate 52 is a plurality of spaced channels 54 which form a plurality of spaced mixing vanes 56 that extend radially outwardly from a central driveshaft mounting hub. These spaced vanes cooperatively form a second impeller which directs any material entering channels 54 in a substantially radial outward direction away from the impeller. As shown, when the impeller 32' is inserted within inlet opening 30 of the pump body 26, the inlets 54*a* of channels 54 are open to the internal cavity 42 facing in the opposite direction of lifting impeller inlets 35, while the channel outlets 54*b* face toward the inner wall 27.

In another embodiment, the integrated second impeller formed within back plate 52 may be replaced with a separate second impeller mounted to the back plate of lifting impeller 32. Like the integrated second impeller, this second impeller would include open channels 54 and vanes 56 substantially the same as those described above.

In a mixing or pre-melting operation, solid particles 50 are introduced into cavity 42 through the upper end of the body 26. As discussed above, when the impeller 32' is turning at rated speed, the flow of molten metal exiting the impeller forms either a forced or super-forced vortex which travels up the body walls 27. The solid particles 50 fall in the axial direction into the inlets 54*a* of the rotating channels 54 formed in the upper surface of back plate 52 and due to the radially extending vanes 56 are re-directed or thrown in a substantially radial direction out of channel outlets 54*b* into the vortex of molten metal. Importantly, the rotational speed of the impeller 32' which is necessary to lift the molten metal up along walls 27 causes the particles 50 being ejected by the radial vanes 56 in the back plate to have sufficient velocity to fully penetrate into the liquid vortex, i.e., beyond the inward-facing surface 40*a* of the vortex, thereby allowing the molten material to fully engulf the solid particles 50 to maximize heating/melting efficiency.

Although the riserless pump 20 has several applications, the general design remains substantially the same except only the lifting capability of the vortex 40 is utilized in the transfer application, while the lifting, mixing and recirculation capabilities are used in conjunction to achieve the ultimate requirements for mixing and pre-melting. The different applications require different curvatures at the body's end 28 generating curves from a) single point curvature to b) cubic or higher point curvatures.

Figure 6:
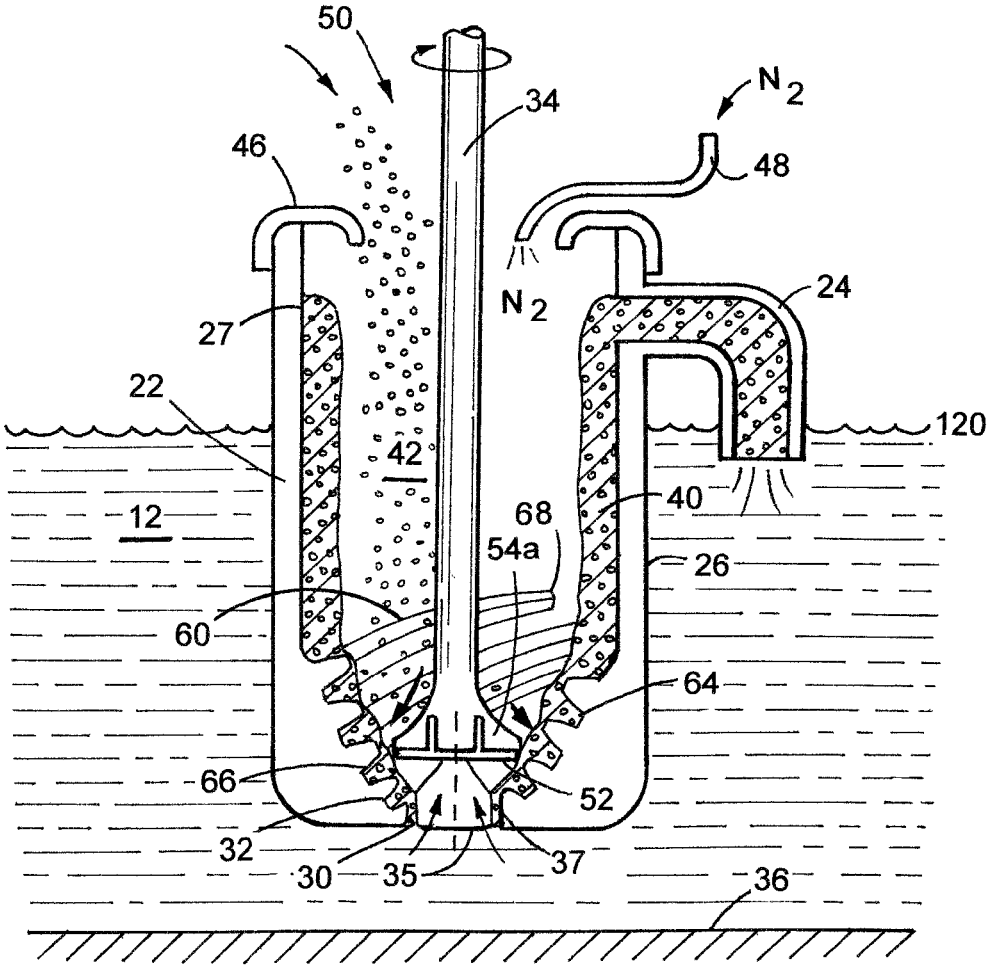
FIG. 6 is a side sectional view of another alternate embodiment of the present invention having a plurality of lifting vanes within the inner wall of the body.

As shown in FIG. 6, for some of the stream-lining requirement in some cases/applications, axial flow curved vanes 60 can be formed inside body 26 proximate to the curved end 28 to enhance the fluid's guidance up and around the inner walls 27. Vanes 60 have a general triangular cross-section, formed by grooves 64 starting at point 66 which is located aligned with the impeller's output and gradually decreasing in pitch height (groove depth) until the terminating portion of the groove 68 is substantially flush with the inner wall to form the helical guide vanes. The vanes 60 cooperate to define fluid channels 64 which guide the fluid ejected from the impeller outlet and wrap helically upward from the lower end 28. In the preferred embodiment, vanes 60 define three complete turns or revolutions within the cavity 42. In addition to helping in the formation of the uplifting vortex of molten metal, the channels 64 also increase the dwell time of any chips 50 that are flung by the impeller's mixing vanes 56 into the molten metal by limiting the upward movement to a desired angle/rate.

From the foregoing description, one skilled in the art will readily recognize that the present invention is directed to an improved molten metal pump system that rotates the molten metal within an internal cavity creating an uplifting vertical vortex of molten metal along the vertical cavity wall, which rises up to an outlet at the upper end of the wall. While the present invention has been described with particular reference to various preferred embodiments, one skilled in the art will recognize from the foregoing discussion and accompanying drawing and claims that changes, modifications and variations can be made in the present invention without departing from the spirit and scope thereof.

The invention claimed is:

1. A molten metal pump comprising: an elongated body having an internal cavity defined by an inner wall which terminates in a bottom end; and a centrifugal impeller seated in an opening formed in the center of said bottom end, wherein molten metal ejected from the impeller is received by the inner wall adjacent the bottom end; and a helical guidance vane formed by grooves in said inner wall starting proximate to said impeller; whereby rotation of the impeller results in the ejected flow of molten metal to create an axially lifting vortex which climbs the body's inner wall to an outlet opening passing through an upper portion of said body.

2. A pump as defined in claim 1, wherein said impeller has vertically downward facing liquid inlets.

3. A pump as defined in claim 2, further comprising a drive shaft extending concentrically down through the tube and attached to a hub formed in a back plate of said impeller.

4. A pump as defined in claim 3, wherein said impeller includes a plurality of radially extending spaced vanes on an upper surface of said back plate, wherein adjacent vanes define channels each having a channel inlet open to said internal cavity and a channel outlet facing said inner wall.

5. A pump as defined in claim 4, wherein said impeller has an outer diameter which is approximately one-fourth to one-third of the diameter of said inner wall, said diameter is a function of a particular specific speed of said impeller.

6. A pump as defined in claim 1, wherein said impeller has an outer diameter which is approximately one-third to one-half of the diameter of said inner wall, said outer diameter is a function of a particular application chosen between a transfer application, a mixing application, and a pre-melting application.

7. A pump which is immersible in a bath of molten metal, comprising:

a vertical body having an inner wall which defines an internal cavity and having outlet means formed at an upper end of the body which fluidly connects the internal cavity to transfer means external to said body, said body having a bottom end which depends inwardly from said inner wall; a centrifugal impeller rotatably seated coaxially within an opening formed in the center of said bottom end, wherein molten metal ejected from the impeller is received by said inner wall; whereby rotation of the impeller results in the ejected molten metal to create an axially lifting vortex within said body and along said inner wall, said vortex climbs the inner wall to said outlet means.

8. A pump as defined in claim 7, wherein said bottom end has a curvature selected from a single point curvature shape and a multiple point curvature shape.

9. A pump as defined in claim 8, wherein said curvature shape is matched to a particular uplifting axial vortex created by said impeller consisting of a forced vortex, a highly forced vortex, and a super-forced vortex.

10. A pump as defined in claim 8, wherein said vortex has a substantially uniform thickness along said inner wall and above said bottom end.

11. A pump as defined in claim 8, further comprising means for mixing solid particulate matter within said vortex, wherein said mixing means is formed within an upper face of said impeller and is effective to redirect said solid particulate matter radially into said uplifting axial vortex.

12. A pump as defined in claim 11, wherein said impeller has liquid inlet openings in a bottom face, said impeller further comprising a plurality of spaced vane arms extending radially along a top face disposed opposite to the bottom face, wherein said spaced vane arms define a plurality of channels having channel inlets which are open axially to said internal cavity and channel outlets which are open radially to said internal cavity.

13. A pump as defined in claim 11, wherein the solid particulate matter entering said channel inlets is ejected through said channel outlets and into said uplifting axial vortex such that said ejected solid particulate matter is fully immersed within said vortex.

14. A pump as defined in claim 11, wherein said impeller has an outer diameter which is approximately one-fourth to one-half of the diameter of said inner wall, said impeller diameter is a function of both a particular specific speed of said impeller and of a particular application chosen between a transfer application, a mixing application, and a pre-melting application.

15. A pump as defined in claim 7 comprising: at least one helical guidance vane climbing inwardly along said inner wall, starting proximate to an outlet opening of said impeller.

16. A method of processing molten metal, comprising the steps of:

providing a pump including a vertical tube-like body and a centrifugal impeller rotatably seated coaxially within an opening formed through a bottom end of said body, wherein said impeller has liquid inlets facing downwardly out of said body; immersing said bottom end of said pump within a bath of molten metal; rotating said impeller within said tube-like body to pull molten metal into said liquid inlets and accelerate said molten metal both radially and tangentially within said body such that molten metal ejected from the impeller forms an uplifting axial vortex along an inner wall of said body; and controlling the speed of said impeller to cause said vortex to climb said inner wall up to and out of an outlet formed in an upper end of said body above a metal line of said molten metal bath.

17. A method as defined in claim 16, wherein said step of providing a pump further comprises the step of forming a radial vane impeller into an upper face of said impeller opposite to said liquid inlets.

18. A method as defined in claim 17, further comprising the steps of:

melting solid metal particles by injecting said solid metal particles into said tube-like body and into inlets in said radial vane impeller, whereby rotation of said impeller accelerates said solid metal particles radially outward to penetrate said vortex created within said body.

19. A method as defined in claim 16, wherein said vortex has a substantially uniform thickness along said riser tube.

20. A method as defined in claim 16 further comprising the step of:

guiding the molten metal ejected from said impeller with at least one helical vane formed within said inner wall.

* * * * *

UNITED STATES PATENT AND TRADEMARK OFFICE

CERTIFICATE OF CORRECTION

PATENT NO. : 9,234,520 B2
APPLICATION NO. : 13/442697
DATED : January 12, 2016
INVENTOR(S) : Jorge A. Morando It is certified that error appears in the above-identified patent and that said Letters Patent is hereby corrected as shown below:

Title Page should read
(73) Assignee (intentionally left blank)

Signed and Sealed this
Nineteenth Day of April, 2016

Michelle K. Lee

Michelle K. Lee
*Director of the United States Patent and Trademark Office*